United States Patent [19]

Johnson

[11] Patent Number: 5,015,501

[45] Date of Patent: May 14, 1991

[54] METHOD AND APPARATUS FOR COATING SMALL PARTS

[76] Inventor: Henry C. Johnson, 18 Montford Close, Horsforth Leeds LS18 5SX, England

[21] Appl. No.: 395,277

[22] Filed: Aug. 17, 1989

[51] Int. Cl.[5] ..... B05D 7/00

[52] U.S. Cl. ..... 427/212; 427/242; 427/372.2; 427/425

[58] Field of Search ..... 118/303; 427/212, 372.2, 427/425, 3, 242

[56] References Cited

U.S. PATENT DOCUMENTS

| | | | |
|---|---|---|---|
| 2,944,512 | 7/1960 | Wilson, Jr. | 118/303 |
| 3,900,583 | 8/1975 | Terry | 427/3 |
| 4,554,887 | 11/1985 | Yoakam et al. | 427/212 X |
| 4,581,242 | 4/1986 | Forster | 427/212 X |
| 4,702,872 | 10/1987 | Yamamoto et al. | 118/303 X |

*Primary Examiner*—Shrive Beck
*Assistant Examiner*—Alain Bashore
*Attorney, Agent, or Firm*—Reising, Ethington, Barnard, Perry & Milton

[57] ABSTRACT

A method of coating small parts comprises placing the parts (18) on a surface capable of being moved, e.g. a conveyor (12), spraying the parts with coating composition, heating the parts to set the coating composition, moving the surface an amount sufficient to invert the parts, and repeating the sequence a multiplicity of times. An apparatus for coating small parts which comprises a movable surface (12), spray means (22), and heating means (24) wherein the movable surface comprises a conveyor belt shaped so as to invert the parts, especially a catenary curve.

5 Claims, 1 Drawing Sheet

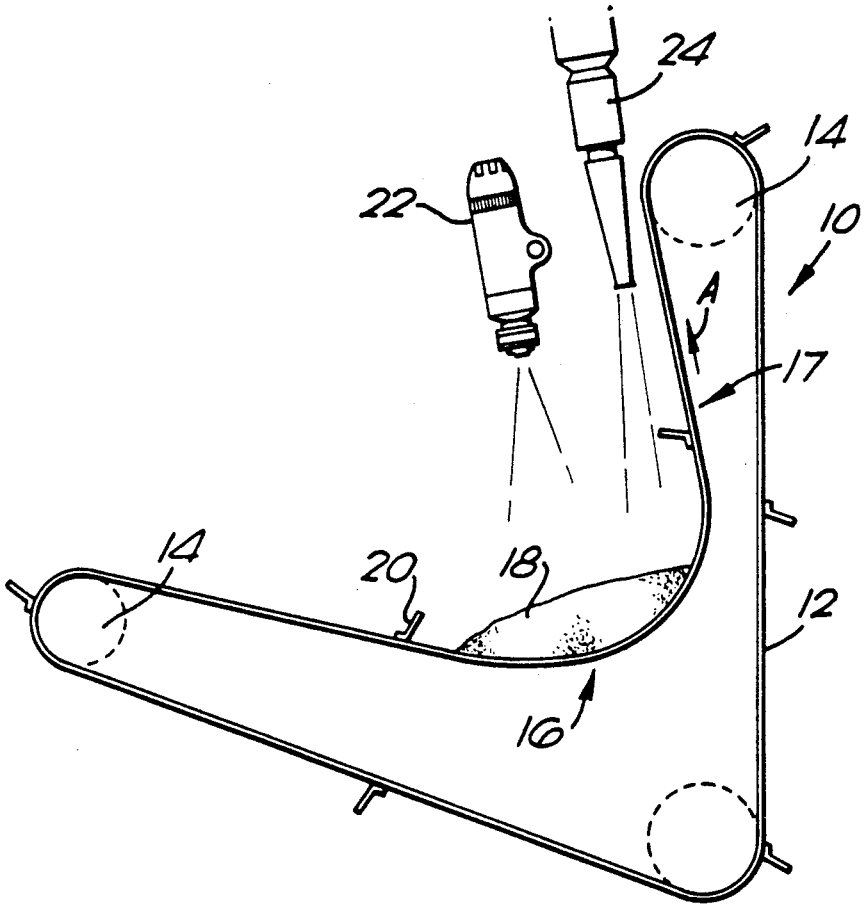
24
14
22
10
A
17
14
20
18
12
16

METHOD AND APPARATUS FOR COATING SMALL PARTS

BACKGROUND OF THE INVENTION

This invention relates to a coating apparatus and a method of coating.

Method for coating small parts such as nuts, bolts, screws, washers, solenoid plungers, and the like at present fall into two main categories. There are labour intensive manual methods which produce a reasonably even coating but are expensive; and there is a semi-automated method involving a machine somewhat like a cement mixer in which the articles to be coated are tumbled within a rotating drum, sprayed with the coating composition and heated to dry/cure the composition. The latter is not very satisfactory since the products are unevenly coated, can be chipped through the dropping action of the tumbling, and/or can stick together in aggregates.

SUMMARY OF THE INVENTION

The invention seeks to provide a method and an apparatus for coating small parts improved in the above respects.

According to the first aspect of the present invention there is provided a method of coating small parts which comprises placing the parts on a surface capable of being moved, spraying the parts with coating composition, heating the parts to set the coating composition, moving the surface an amount sufficient to invert the parts, and repeating the sequence a multiplicity of times.

Typically the sequence above will be repeated twenty or more times, e.g. thirty times, in order to give a very even coating—considerably superior to that which can be achieved by previous automatic methods and approaching that achievable by labour intensive manual methods.

According to a second aspect of the present invention there is provided an apparatus for coating small parts which comprises a movable surface, spray means, and heating means characterised in that the movable surface comprises a conveyor belt shaped so as to invert the parts.

Previous apparatus invariably employed a rotating drum of the 'cement mixer' type and, as this rotated, the necessarily circular internal configuration gave very rapid lift of the parts followed by a drop which could cause chipping. Using a conveyor belt allows the angle of lift to be reduced resulting in a much gentler, "folding" action. Baffles, termed 'lifters', may be provided at intervals across the conveyor to aid/modify the motion.

BRIEF DESCRIPTION OF THE DRAWING

The invention will be described further, by way of example, with reference to the accompanying drawing, in which the sole FIGURE is a diagrammatic side view of an apparatus in accordance with the invention.

DESCRIPTION OF THE PREFERRED EMBODIMENT

Referring to the drawing an apparatus for coating small parts generally designated 10 comprises an endless conveyor belt 12 moved on rollers 14. The conveyor runs in guides (not shown) to provide a concave area 16 in the operative zone. The shape of the conveyor is a catenary rather than a sector of a circle. Especially important is angle of the upper portion 17 of the conveyor since it is desired to turn or "fold" back parts placed in the area 16 without dropping them or agitating them too greatly. It has been found that if the upper portion 17 is inclined back at an angle of from 15° to 30° to the vertical, typically about 23°, the required folding action is obtained. The area 16 receives a plurality of small parts 18 to be coated. The belt is provided with a series of baffles or lifters 20 which help ensure proper inverting or "folding" of the parts 18 as will be described more fully hereinafter.

Adjacent the operative zone there is also provided a spray head 22 for spraying the desired coating composition on to the parts 18 together with heating means for example a hot air jet 24 for setting or curing the coating composition.

Operation of the apparatus is as follows. Parts 18 are placed into the concave zone 16 of the conveyor 12 and initially sprayed with a small measured quantity of coating composition. The spray pattern is confined to the central area of the heap 18 between the sides of the conveyor 12. This ensures that little or no coating composition is wasted. Heat is then applied by means of the air jets 24 to set or cure the composition. The conveyor is then set in motion rotating in the direction of the arrow A a measured amount; typically the belt moves a distance corresponding to the spacing between adjacent lifters 20 thus "folding" the heap 18 and effectively inverting the parts. While not all the parts will be exactly inverted, repetition of the process enough times ensures that all the parts will be treated sufficiently evenly. After this movement the conveyor is stopped and the spray and heating cycle is repeated. The whole cycle is repeated twenty or more times gradually building up the coating on each of the parts until the desired thickness had been attained. The coating produced by the method and apparatus of the invention has been found to be extremely even. There is better than 90% utilisation of the coating composition, and chipping is eliminated.

Typical coating thicknesses are in the range of 25 to 40 microns but the apparatus of the invention can easily achieve coating thicknesses below this with satisfactory evenness. The important parameter is the differential in thickness between the thickest and thinnest parts of the coating on a given product. This differential should be as low as possible, that is the coating should be as even as possible. The apparatus and method of the invention have been found to give coatings much more even than existing automatic machinery and comparable with expensive and time consuming manual methods.

A variety of coating compositions can be employed in the method of the invention: release coatings, anti-corrosion coatings, paints, lacquers, and the like; indeed the method can be applied to coating food or pharaceutical products such as sweets or pills.

The method and apparatus of the invention provide a simple and economical way of producing even coatings on small parts in an automatic fashion. Preferrably the conveyor spray head and heat source are micro-processor cntrolled so that once the small parts 18 have been loaded the complete process proceeds without manual intervention. The positioning and number (or even the presence) of the lifters 20 can be varied to suit the nature of the parts 18 being coated. The length of movement of the conveyor will then normally be adjusted to suit. For example, for smaller parts the distance between the lifters, and thus the length of movement of the conveyor, can be reduced. For a given machine speed this results in faster processing times.

I claim:

1. A method of coating small parts which comprises the sequential steps of placing the parts on a stationary surface capable of being moved, spraying the parts with coating composition while stationary on said surface, heating the parts to set the coating composition, moving the surface an amount sufficient to invert the parts, stopping the movement of the surface and repeating the sequence a multiplicity of times.

2. A method as claimed in claim 1 in which the sequence is repeated twenty or more times.

3. A method as claimed in claim 2 in which the sequence is repeated about thirty times.

4. A method as claimed in any of claims 1 to 3 in which the surface carries baffles and is moved a distance corresponding to the distance between baffles.

5. A method as claimed in claim 1 in which the spraying is confined to the central portion of the parts.

* * * * *